US009873591B2

(12) United States Patent
Kattainen et al.

(10) Patent No.: US 9,873,591 B2
(45) Date of Patent: Jan. 23, 2018

(54) BRAKE CONTROLLER, ELEVATOR SYSTEM AND A METHOD FOR PERFORMING AN EMERGENCY STOP WITH AN ELEVATOR HOISTING MACHINE DRIVEN WITH A FREQUENCY CONVERTER

(71) Applicant: KONE Corporation, Helsinki (FI)

(72) Inventors: Ari Kattainen, Hyvinkää (FI); Pasi Raassina, Numminen (FI); Tapio Saarikoski, Hyvinkää (FI); Lauri Stolt, Helsinki (FI); Arto Nakari, Hyvinkää (FI); Antti Kallioniemi, Jokela (FI)

(73) Assignee: KONE CORPORATION, Helsinki (FI)

( * ) Notice: Subject to any disclaimer, the term of this patent is extended or adjusted under 35 U.S.C. 154(b) by 547 days.

(21) Appl. No.: 14/533,764

(22) Filed: Nov. 5, 2014

(65) Prior Publication Data

US 2015/0053507 A1 Feb. 26, 2015

Related U.S. Application Data

(63) Continuation of application No. PCT/FI2013/050541, filed on May 20, 2013.

(30) Foreign Application Priority Data

May 31, 2012 (FI) ..... 20125596

(51) Int. Cl.
*B66B 1/32* (2006.01)
*B66B 5/02* (2006.01)
(Continued)

(52) U.S. Cl.
CPC ..... *B66B 5/02* (2013.01); *B66B 1/32* (2013.01); *B66B 5/00* (2013.01); *B66B 5/0031* (2013.01);
(Continued)

(58) Field of Classification Search
CPC .... B66B 5/02; B66B 1/32; B66B 5/00; B66B 5/0031; B66B 5/06; B66B 13/22; B66B 1/30
(Continued)

(56) References Cited

U.S. PATENT DOCUMENTS 4,974,703 A * 12/1990 Nomura ..... B66B 1/32 187/288
6,056,088 A 5/2000 Gerstenkorn
(Continued)

FOREIGN PATENT DOCUMENTS

CN 85103125 A 10/1986
CN 101687605 A 3/2010
(Continued)

*Primary Examiner* — Anthony Salata
(74) *Attorney, Agent, or Firm* — Birch, Stewart, Kolasch & Birch, LLP

(57) ABSTRACT

A brake controller, an elevator system and a method for performing an emergency stop are provided. The brake controller includes an input for connecting the brake controller to the DC intermediate circuit of the frequency converter driving the hoisting machine of the elevator, an output for connecting the brake controller to the electromagnet of the brake, a switch for supplying electric power from the DC intermediate circuit of the frequency converter driving the hoisting machine of the elevator via the output to the electromagnet of a brake, and also a processor with which the operation of the brake controller is controlled by producing control pulses in the control pole of the switch of the brake controller.

14 Claims, 5 Drawing Sheets

1: frequency converter
3: motor bridge
6: hoisting machine
7: brake controller
10: first/second electromagnet
11: DSP processor
13: safety signal
15: drive prevention logic
16: brake switching logic
20: electronic supervision unit
25: electricity network
26: rectifier
27: pulse encoder
28: normally-closed safety switches
30: communications bus
35: elevator control unit
49: intermediate circuit capacitors
60: elevator car
61: acceleration sensor
62: communications interface
63: memory
65: stop request
66: hoistway
2A: positive busbar of the DC intermediate circuit
2B: negative busbar of the DC intermediate circuit
9A: first machinery brake
9B: second machinery brake

(51) Int. Cl.
*B66B 5/00* (2006.01)
*B66B 5/06* (2006.01)
*B66B 13/22* (2006.01)
*B66B 1/30* (2006.01)

(52) U.S. Cl.
CPC ..... *B66B 5/06* (2013.01); *B66B 13/22* (2013.01); *B66B 1/30* (2013.01)

(58) Field of Classification Search
USPC ..... 187/247, 377, 288, 291, 293, 391–393; 318/66, 362
See application file for complete search history.

(56) References Cited

U.S. PATENT DOCUMENTS 6,802,395 B1 * 10/2004 Helstrom ..... B66B 5/02 187/247
7,669,697 B2 * 3/2010 Ueda ..... B66B 5/02 187/292
7,730,998 B2 * 6/2010 Takahashi ..... B66B 1/32 187/287
7,740,110 B2 * 6/2010 Kattainen ..... B66B 1/32 187/288
7,891,466 B2 * 2/2011 Okamoto ..... B66B 5/02 187/287
7,896,136 B2 * 3/2011 Shibata ..... B66B 5/02 187/287
7,918,320 B2 * 4/2011 Kondo ..... B66B 5/0031 187/288
7,938,231 B2 * 5/2011 Ueda ..... B66B 5/02 187/288
8,272,482 B2 * 9/2012 Takahashi ..... B66B 1/32 187/288
8,297,411 B2 * 10/2012 Hashimoto ..... B66B 1/285 187/288
8,365,872 B2 * 2/2013 Ueda ..... B66B 5/04 187/248
8,869,945 B2 * 10/2014 Harkonen ..... B66B 1/28 187/288
2009/0120725 A1 5/2009 Syrman et al.
2010/0025162 A1 2/2010 Okamoto et al.
2010/0109596 A1 5/2010 Jahkonen
2011/0278099 A1 11/2011 Kattainen et al.

FOREIGN PATENT DOCUMENTS

WO WO 00/51929 A1 9/2000
WO WO 2007/108068 A1 9/2007
WO WO 2008/129672 A1 10/2008
WO WO 2008/135626 A1 11/2008
WO WO 2011/051571 A1 5/2011

* cited by examiner

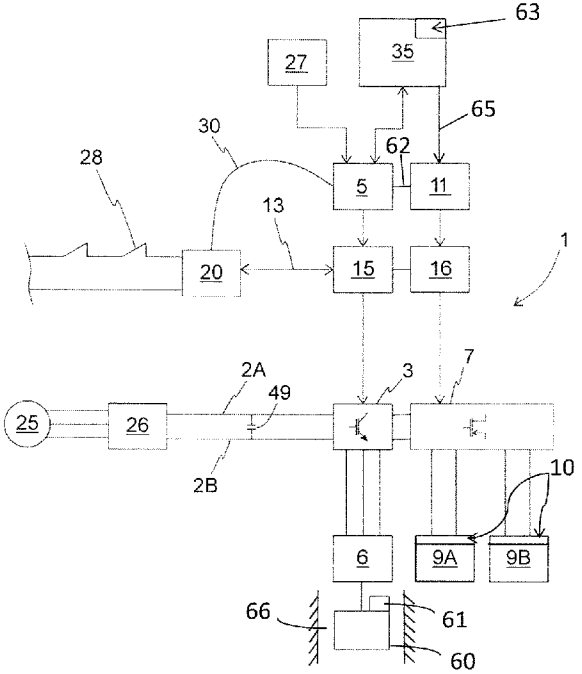

Fig. 1

1: frequency converter
3: motor bridge
6: hoisting machine
7: brake controller
10: first/second electromagnet
11: DSP processor
13: safety signal
15: drive prevention logic
16: brake switching logic
20: electronic supervision unit
25: electricity network
26: rectifier 27: pulse encoder
28: normally-closed safety switches
30: communications bus
35: elevator control unit
49: intermediate circuit capacitors
60: elevator car
61: acceleration sensor
62: communications interface
63: memory
65: stop request
66: hoistway 2A: positive busbar of the DC intermediate circuit
2B: negative busbar of the DC intermediate circuit
9A: first machinery brake
9B: second machinery brake

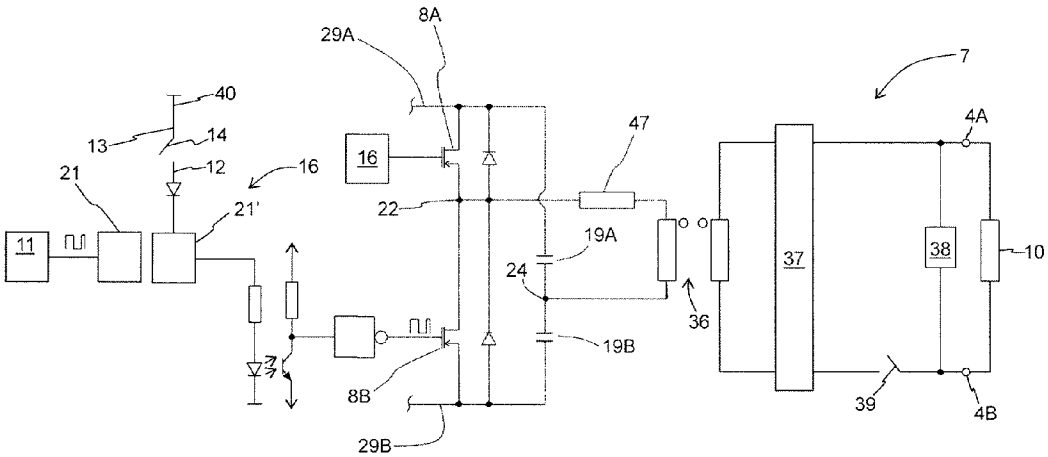

Fig. 2

4A, 4B: output
7: brake controller
8A, 8B: MOSFET transistors
10: first/second electromagnet
11: brake control circuit
12: input circuit
13: safety signal
14: contacts
16: brake switching logic
19A, 19B: capacitors
21: digital isolator
21':secondary side of the digital isolator
22: connection point
24: connection point
29A, 29B: input
36: transformer
37: rectifying bridge
38: current damping circuit
39: MOSFET transistor
40: DC voltage source
47: choke

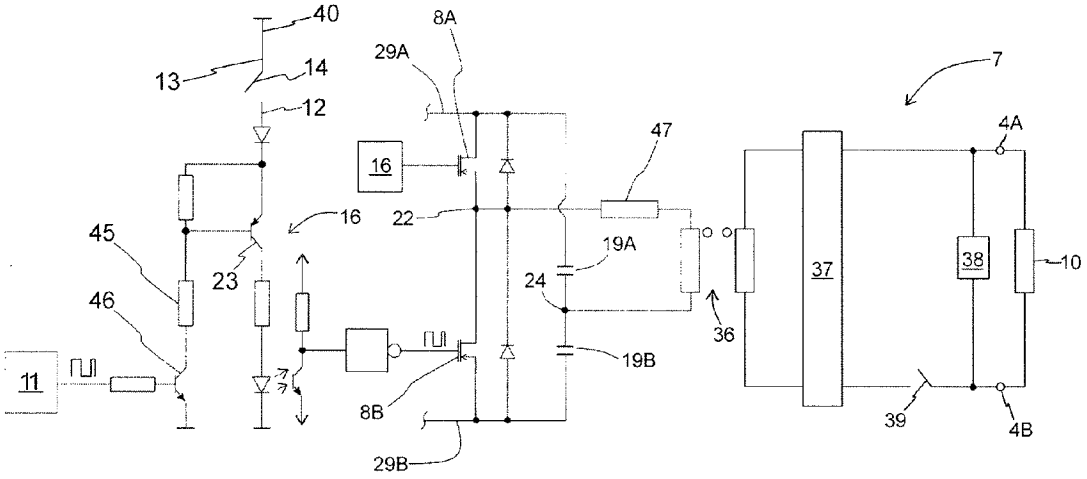

Fig. 3

4A, 4B: output
7: brake controller
8A, 8B: MOSFET transistors
10: first/second electromagnet
11: brake control circuit
12: input circuit
13: safety signal
14: contacts
16: brake switching logic
19A, 19B: capacitors
22: connection point
23: PNP transistor
24: connection point
29A, 29B: input
36: transformer
37: rectifying bridge
38: current damping circuit
39: MOSFET transistor
40: DC voltage source
45: MELF resistor
46: transistor
47: choke 1: frequency converter
12: input circuit
13: safety signal
14: contacts
15: drive prevention logic
16: brake switching logic
17: indicator logic
18: signal
20: electronic supervision unit
40: DC voltage source 1: frequency converter
12: input circuit
15: drive prevention logic
16: brake switching logic
28: safety switches
34: safety circuit
40: DC voltage source
41: diodes
44: safety relay
2B: negative busbar of the DC intermediate circuit

BRAKE CONTROLLER, ELEVATOR SYSTEM AND A METHOD FOR PERFORMING AN EMERGENCY STOP WITH AN ELEVATOR HOISTING MACHINE DRIVEN WITH A FREQUENCY CONVERTER

CROSS REFERENCE TO RELATED APPLICATIONS

This application is a Continuation of PCT International Application No. PCT/FI2013/050541, filed on May 20, 2013, which claims priority under 35 U.S.C. 119(a) to Patent Application No. 20125596, filed in the Finland on May 31, 2012, all of which are hereby expressly incorporated by reference into the present application.

FIELD OF THE INVENTION

The invention relates to controllers of a brake of an elevator.

BACKGROUND OF THE INVENTION

In an elevator system electromagnetic brakes are used as, inter alia, holding brakes of the hoisting machine and also as car brakes, which brake the movement of the elevator car by engaging with a vertical guide rail that is in the elevator hoistway.

The electromagnetic brake is opened by supplying current to the coil of the electromagnet of the brake and connected by disconnecting the current supply of the coil of the electromagnet of the brake.

Conventionally, relays have been used for the current supply/disconnection of the current supply, said relays being connected in series between a power source and the coil of the electromagnet of the brake.

Connecting a relay causes a noise, which might disturb the residents of a building. Relays are also large in size, owing to which their placement might be awkward, especially in elevator systems that have no machine room. As mechanical components, relays also wear rapidly and they might fail when, among other things, the contacts corrode or when they weld closed.

AIM OF THE INVENTION

One aim of the invention is to disclose a quieter brake control circuit, which also fits into a smaller space. This aim can be achieved with a brake controller and an elevator system according to the present invention.

One aim of the invention is to disclose a solution that enables an emergency stop of an elevator at a reduced deceleration in connection with a functional nonconformance, such as an electricity outage. This aim can be achieved with a brake controller, an elevator system and a method according to the present invention.

The preferred embodiments of the invention are described in the dependent claims. Some inventive embodiments and inventive combinations of the various embodiments are also presented in the descriptive section and in the drawings of the present application.

SUMMARY OF THE INVENTION

The brake controller according to the invention for controlling an electromagnetic brake of an elevator comprises an input for connecting the brake controller to the DC intermediate circuit of the frequency converter driving the hoisting machine of the elevator, an output for connecting the brake controller to the electromagnet of the brake, a solid-state switch for supplying electric power from the DC intermediate circuit of the frequency converter driving the hoisting machine of the elevator via the output to the electromagnet of a brake, and also a processor, with which the operation of the brake controller is controlled by producing control pulses in the control pole of the switch of the brake controller.

The invention enables the integration of the brake controller into the DC intermediate circuit of the frequency converter of the hoisting machine of the elevator. This is advantageous because the combination of the frequency converter and the brake controller is necessary from the viewpoint of the safe operation of the hoisting machine of the elevator and, consequently, from the viewpoint of the safe operation of the whole elevator. In addition, the size of the brake controller and also of the frequency converter decreases, which enables space saving e.g. in an elevator system having no machine room. The brake controller according to the invention can also be connected as a part of the safety arrangement of an elevator via a safety signal, in which case the safety arrangement of the elevator is simplified and it can be implemented easily in many different ways. Additionally, the combination of the safety signal and the brake switching logic according to the invention enables the brake controller to be implemented completely without mechanical contactors, using only solid-state components. When eliminating contactors, also the disturbing noise produced by the operation of the contactors is removed. Most preferably the input circuit of the safety signal and the brake switching logic are implemented only with discrete solid-state components, i.e. without integrated circuits. In this case analysis of the effect of different fault situations as well as of e.g. EMC interference connecting to the input circuit of the safety signal from outside is facilitated, which also facilitates connecting the brake controller to different elevator safety arrangements.

Since the brake controller can be connected to the DC intermediate circuit of the frequency converter, the energy returning to the DC intermediate circuit in connection with motor braking of the elevator motor can be utilized in the brake control, which improves the efficiency ratio of the elevator. In addition, the main circuit of the brake controller becomes simpler. In addition to this, connecting the brakes in connection with an emergency stop caused by an electricity outage can be stepped by first disconnecting the electricity supply to the electromagnet of only one brake and by continuing the electricity supply to the electromagnets of the other brakes. This is possible because there is electrical energy available in the DC intermediate circuit of the frequency converter during an electricity outage, inter alia charged into the capacitors of the DC intermediate circuit; in addition, as long as motor braking continues, energy also returns to the intermediate circuit during an electricity outage.

In a preferred embodiment of the invention the brake controller comprises an input circuit for a safety signal, which safety signal can be disconnected/connected from outside the brake controller.

In a preferred embodiment of the invention the brake controller comprises brake switching logic, which is connected to the input circuit and is configured to prevent passage of the control pulses to the control pole of the switch of the brake controller when the safety signal is disconnected.

The supply of electric power to the control coil of the electromagnetic brake can consequently be disconnected without mechanical contactors, by preventing the passage of control pulses to the control pole of the switch of the brake controller with the brake switching logic according to the invention. The solid-state switch of the brake controller can be e.g. a MOSFET or a silicon carbide (SiC) MOSFET transistor.

In a preferred embodiment of the invention the brake switching logic is configured to allow passage of the control pulses to the control pole of the switch of the brake controller when the safety signal is connected.

In a preferred embodiment of the invention the brake controller comprises indicator logic for forming a signal permitting startup of a run. The indicator logic is configured to activate, and on the other hand to disconnect, the signal permitting startup of a run on the basis of the status data of the brake switching logic.

In a preferred embodiment of the invention the signal path of the control pulses travels to the control pole of the switch of the brake controller travels via the brake switching logic, and the electricity supply to the brake switching logic is arranged via the signal path of the safety signal.

By arranging the electricity supply to the brake switching logic via the signal path of the safety signal, it can be ensured that the electricity supply to the brake switching logic disconnects, and that the passage of control pulses to the control poles of the switches of the brake controller consequently ceases, when the safety signal is disconnected. In this case by disconnecting the safety signal, the power supply to the control coil of the electromagnetic brake can be disconnected in a fail-safe manner without separate mechanical contactors.

In a preferred embodiment of the invention the signal path of the control pulses from the processor to the brake switching logic is arranged via an isolator. In this context an isolator means a component that disconnects the passage of an electrical charge along a signal path. In an isolator the signal is consequently transmitted e.g. as electromagnet radiation (opto-isolator) or via a magnetic field or electrical field (digital isolator). With the use of an isolator, the passage of charge carriers from the brake control circuit to the brake switching logic is prevented e.g. when the brake control circuit fails into a short-circuit.

In a preferred embodiment of the invention the brake switching logic comprises a bipolar or multipolar signal switch, via which the control pulses travel to the control pole of the switch of the brake controller. At least one pole of the signal switch is connected to the input circuit in such a way that the signal path of the control pulses through the signal switch breaks when the safety signal is disconnected.

In a preferred embodiment of the invention the electricity supply occurring via the signal path of the safety signal is configured to be disconnected by disconnecting the safety signal.

In a preferred embodiment of the invention the brake controller is implemented without a single mechanical contactor.

In a preferred embodiment of the invention the brake controller comprises two outputs to be controlled with a processor independently of each other, via the first of which outputs electric power is supplied from the DC intermediate circuit of the frequency converter driving the hoisting machine of the elevator to the first electromagnet of a brake and via the second output electric power is supplied from the DC intermediate circuit of the frequency converter driving the hoisting machine of the elevator to a second electromagnet.

In a preferred embodiment of the invention the brake controller comprises two controllable switches, the first of which is configured to supply electric power to a first electromagnet of a brake and the second is configured to supply electric power to a second electromagnet of the brake. The processor is configured to control the electricity supply to the first electromagnet by producing control pulses in the control pole of the first switch, and the processor is configured to control the electricity supply to the second electromagnet by producing control pulses in the control pole of the second switch.

In a preferred embodiment of the invention the processor comprises a communications interface (e.g., 62 in FIG. 1), via which the processor is connected to the elevator control. The brake controller is configured to disconnect the electricity supply to the first electromagnet but to continue the electricity supply from the DC intermediate circuit of the frequency converter to the second electromagnet after it has received from the elevator control an emergency stop request for starting an emergency stop to be performed at a reduced deceleration.

In a preferred embodiment of the invention the brake controller is configured to disconnect the electricity supply to the first and to the second electromagnet after it has received from the elevator control a signal that the deceleration of the elevator car is below a threshold value.

The invention also relates to a brake controller for controlling an electromagnetic brake of an elevator. The brake controller comprises an input for connecting the brake controller to a DC electricity source, an output for connecting the brake controller to the electromagnet of a brake, a transformer, which comprises a primary circuit and a secondary circuit, and also a rectifying bridge, which is connected between the secondary circuit of the transformer and the output of the brake controller. The input comprises a positive and a negative current conductor, and the brake controller comprises a high-side switch and a low-side switch, which are connected in series with each other between the aforementioned positive and aforementioned negative current conductor, and also a processor, with which the electricity supply to the electromagnet of the brake is controlled by producing control pulses in the control poles of the high-side switch and low-side switch. The brake controller also comprises two capacitors, which are connected in series with each other between the aforementioned positive and aforementioned negative current conductor The primary circuit of the transformer is connected between the connection point of the aforementioned high-side switch and aforementioned low-side switch and the connection point of the aforementioned capacitors. The aforementioned DC voltage source to be connected to the input is most preferably the DC intermediate circuit of the frequency converter driving the hoisting machine of the elevator. In the aforementioned circuit the voltage of the capacitors reduces the voltage over the primary circuit of the transformer, as a result of which the positive and negative current conductor in the input of the brake controller can be connected to the high-voltage DC intermediate circuit of the frequency converter without the special requirements of the transformer increasing unreasonably. The voltage of the DC intermediate circuit of the frequency converter is preferably approx. 500 V-700 V. In a preferred embodiment of the invention a separate choke is also connected between the primary circuit of the transformer and the connection point of the high-side and low-side switches. The choke reduces the current ripple of the transformer and facilitates adjustment of the current.

The elevator system according to the invention comprises a brake controller according to the description for controlling the brake of the hoisting machine of the elevator.

In a preferred embodiment of the invention the elevator system comprises a hoisting machine, an elevator car, a frequency converter, with which the elevator car is driven by supplying electric power to the hoisting machine, sensors configured to monitor the safety of the elevator, and also an elevator control, which comprises an input for the data of the aforementioned sensors. The elevator control is configured to form an emergency stop request for starting an emergency stop to be performed at a reduced deceleration, when the data received from the sensors indicates that the safety of the elevator is endangered.

In a preferred embodiment of the invention the elevator system comprises an acceleration sensor, which is connected to the elevator car, and the elevator control comprises an input for the measuring data of the acceleration sensor. The elevator control also comprises a memory (e.g., 63 in FIG. 1), in which is recorded a threshold value of the deceleration of the elevator car, and the elevator control is configured to compare the measuring data of the acceleration sensor to the threshold value for the deceleration of the elevator car recorded in memory, and also to form a signal that the deceleration of the elevator car is below the threshold value.

In the method according to the invention for performing an emergency stop with an elevator hoisting machine driven with a frequency converter, one of the brakes of the hoisting machine is connected by disconnecting the electricity supply to the electromagnet of the aforementioned brake, but the other brakes of the hoisting machine are still kept open by continuing the electricity supply from the DC intermediate circuit of the frequency converter to the electromagnets of the aforementioned other brakes of the hoisting machine.

In a preferred embodiment of the invention the deceleration during an emergency stop of the elevator car is measured, and after a set period of time has passed also at least one second brake of the hoisting machine is connected after the deceleration of the elevator car is below a set threshold value.

The preceding summary, as well as the additional features and additional advantages of the invention presented below, will be better understood by the aid of the following description of some embodiments, said description not limiting the scope of application of the invention.

BRIEF EXPLANATION OF THE FIGURES

FIG. 1 presents as a block diagram an elevator system according to one embodiment of the invention.

FIG. 2 presents as a circuit diagram a brake control circuit according to one embodiment of the invention.

FIG. 3 presents as a circuit diagram a brake control circuit according to one second embodiment of the invention.

MORE DETAILED DESCRIPTION OF PREFERRED EMBODIMENTS OF THE INVENTION

Figure 4:
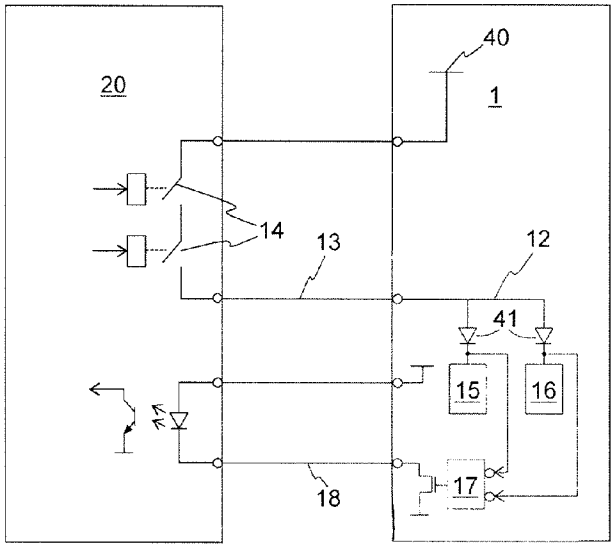
FIG. 4 presents the circuit of the safety signal in the safety arrangement of an elevator according to FIG. 3.

FIG. 1 presents as a block diagram an elevator system, in which an elevator car 60 is driven in an elevator hoistway 66 with the hoisting machine 6 of the elevator via rope friction or belt friction. The speed of the elevator car is adjusted to be according to the target value for the speed of the elevator car, i.e. the speed reference, calculated by the elevator control unit 35. The speed reference is formed in such a way that passengers can be transferred from one floor to another with the elevator car on the basis of elevator calls given by elevator passengers.

The elevator car is connected to the counterweight with ropes or with a belt traveling via the traction sheave of the hoisting machine. Various roping solutions known in the art can be used in an elevator system, and they are not presented in more detail in this context. The hoisting machine 6 also comprises an elevator motor, which is an electric motor, with which the elevator car is driven by rotating the traction sheave, as well as two electromagnetic brakes 9A, 9B, with which the traction sheave is braked and held in its position.

Both electromagnetic brakes 9A, 9B of the hoisting machine comprise a frame part fixed to the frame of the hoisting machine and also an armature part movably supported on the frame part. The brake 9A, 9B comprises thruster springs, which resting on the frame part engage the brake by pressing the armature part onto the braking surface on the shaft of the rotor of the hoisting machine or e.g. on the traction sheave to brake the movement of the traction sheave. The frame part of the brake 9A, 9B comprises an electromagnet (i.e. a control coil), which when energized exerts a force of attraction between the frame part and the armature part. The brake is opened by supplying with the brake controller 7 current to the control coil of the brake, in which case the force of attraction of the electromagnet pulls the armature part off the braking surface and the braking force effect ceases. Correspondingly, the brake is connected by disconnecting the current supply to the control coil of the brake. With the brake controller 7 the electromagnetic brakes 9A, 9B of the hoisting machine are controlled independently of each other by supplying current separately to the control coil 10 of both electromagnetic brakes 9A, 9B.

The hoisting machine 6 is driven with the frequency converter 1, by supplying electric power with the frequency converter 1 from the electricity network 25 to the electric motor of the hoisting machine 6. The frequency converter 1 comprises a rectifier 26, with which the voltage of the AC network 25 is rectified for the DC intermediate circuit 2A, 2B of the frequency converter. The DC intermediate circuit 2A, 2B comprises one or more intermediate circuit capacitors 49, which function as temporary stores of electrical energy. The DC voltage of the DC intermediate circuit 2A, 2B is further converted by the motor bridge 3 into the variable-amplitude and variable-frequency supply voltage of the electric motor.

During motor braking electric power also returns from the electric motor via the motor bridge 3 back to the DC intermediate circuit 2A, 2B, from where it can be supplied onwards back to the electricity network 25 with a rectifier 26. The power returning to the DC intermediate circuit 2A, 2B during motor braking is also stored in an intermediate circuit capacitor 49. During motor braking the force effect of the electric motor 6 is in the opposite direction with respect to the direction of movement of the elevator car. Consequently, motor braking occurs e.g. in an elevator with counterweight when driving an empty elevator car upwards or when driving a fully loaded elevator car downwards.

The elevator system according to FIG. 1 comprises mechanical normally-closed safety switches 28, which are configured to supervise the position/locking of entrances to the elevator hoistway as well as e.g. the operation of the overspeed governor of the elevator car. The safety switches of the entrances of the elevator hoistway are connected to each other in series. Opening of a safety switch 28 consequently indicates an event affecting the safety of the elevator system, such as the opening of an entrance to the elevator hoistway, the arrival of the elevator car at an extreme limit switch for permitted movement, activation of the overspeed governor, et cetera.

The elevator system comprises an electronic supervision unit 20, which is a special microprocessor-controlled safety device fulfilling the EN IEC 61508 safety regulations and designed to comply with SIL 3 safety integrity level. The safety switches 28 are wired to the electronic supervision unit 20. The electronic supervision unit 20 is also connected with a communications bus 30 to the frequency converter 1, to the elevator control unit 35 and to the control unit of the elevator car, and the electronic supervision unit 20 monitors the safety of the elevator system on the basis of data it receives from the safety switches 28 and from the communications bus. The electronic supervision unit 20 forms a safety signal 13, on the basis of which a run with the elevator can be allowed or, on the other hand, prevented by disconnecting the power supply of the elevator motor 6 and by activating the machinery brakes 9A, 9B to brake the movement of the traction sheave of the hoisting machine. Consequently, the electronic supervision unit 20 prevents a run with the elevator e.g. when detecting that an entrance to the elevator hoistway has opened, when detecting that an elevator car has arrived at the extreme limit switch for permitted movement, and when detecting that the overspeed governor has activated. In addition, the electronic supervision unit receives the measuring data of a pulse encoder 27 from the frequency converter 1 via the communications bus 30, and monitors the movement of the elevator car in connection with, inter alia, an emergency stop on the basis of the measuring data of the pulse encoder 27 it receives from the frequency converter 1. The frequency converter 1 is provided with a safety logic 15, 16 to be connected to the signal path of the safety signal 13, which safety logic disconnects the power supply of the elevator motor and also connects the machinery brakes 9A, 9B.

The safety logic is formed from the drive prevention logic 15 and also from the brake switching logic 16.

The circuit diagram of the main circuit of the brake switching logic 16 and of the brake controller 7 is presented in more detail in FIGS. 2 and 3. For the sake of clarity FIGS. 2 and 3 present a circuit diagram in connection with only the one brake 9A, 9B, because the circuit diagrams are similar in connection with both brakes 9A, 9B. With the DSP processor 11 of FIGS. 2, 3, however, both brakes 9A, 9B are controlled.

In FIGS. 2 and 3 the brake controller 7 is connected to the DC intermediate circuit 2A, 2B of the frequency converter 1, and the current supply to the control coils 10 of the electromagnetic brakes 9A, 9B occurs from the DC intermediate circuit 2A, 2B.

The brake controller 7 of FIG. 2 comprises an input, the positive current conductor 29A of which is connected to the positive busbar 2A of the DC intermediate circuit of the frequency converter and the negative current conductor 29B is connected to the negative busbar 2B of the DC intermediate circuit of the frequency converter. The output of the brake controller comprises a connector 4A, 4B, to which the supply cables of the control coil 10 of the brake are connected. The brake controller 7 comprises a transformer 36, which comprises a primary circuit and a secondary circuit as well as a rectifying bridge 37, which is connected between the secondary circuit of the transformer and the output 4A, 4B of the brake controller. A high-side MOSFET transistor 8A and also a low side-MOSFET transistor 8B are connected between the positive 29A and the negative 29B current conductor, which transistors are connected in series with each other. A choke 47, which reduces the current ripple of the transformer, is additionally connected between the primary circuit of the transformer 36 and the connection point 22 of the high-side and low-side MOSFET transistors 8A, 8B. Also, between the aforementioned current conductors 29A, 29B are two capacitors 19A, 19B connected in series with each other. The primary circuit of the transformer 36 and the choke 47 are connected between the connection point 22 of the aforementioned high-side MOSFET transistor 8A and aforementioned low-side MOSFET transistor 8B and the connection point 24 of the aforementioned capacitors 19A, 19B. Since the voltage of the connection point 24 of the capacitors is somewhere between the voltages of the negative 2A and the positive 2B busbar of the DC intermediate circuit of the frequency converter, this type of circuit reduces the voltage stress of the primary circuit of the transformer 36 and of the choke 47 connected in series with the primary circuit. This is advantageous because the voltage between the positive 2A and the negative 2B busbar of the DC intermediate circuit can be rather high, up to approx. 800 volts or momentarily even higher. In some embodiments silicon carbide (SiC) MOSFET transistors are used, instead of MOSFET transistors 8A, 8B, as the high-side 8A and low-side 8B switches. Being low-loss components, silicon carbide (SiC) MOSFET transistors enable an increase in the current supply capability of the brake controller 7 without the size of the brake controller 7 becoming too large. In FIG. 2 there are parallel-connected flyback diodes connected in parallel with the MOSFET transistors, which diodes are most preferably Schottky diodes and most preferably of all silicon carbide Schottky diodes.

The high-side 8A and the low-side 8B MOSFET transistors are connected alternately by producing with the DSP processor 11 short, preferably PWM modulated, pulses in the gates of the MOSFET transistors 8A, 8B. The switching frequency is preferably approx. 100 kilohertz-150 kilohertz. This type of high switching frequency enables the size of the transformer 36 to be minimized. With the rectifier 37 in the secondary circuit of the transformer 36 the secondary voltage of the transformer is rectified, after which the rectified voltage is supplied to the control coil 10 of the electromagnetic brake. A current damping circuit 38 is also connected in parallel with the control coil 10 on the secondary side of the transformer, which current damping circuit comprises one or more components (e.g. a resistor, capacitor, varistor, et cetera), which receive(s) the energy stored in the inductance of the control coil of the brake in connection with disconnection of the current of the control coil 10, and consequently accelerate(s) disconnection of the current of the control coil 10 and activation of the brake 9. Accelerated disconnection of the current occurs by opening the MOSFET transistor 39 in the secondary circuit of the brake controller, in which case the current of the coil 10 of the brake commutates to travel via the current damping circuit 38. The brake controller to be implemented with the transformer described here is particularly fail-safe, especially from the viewpoint of earth faults, because the power supply from the DC intermediate circuit 2A, 2B to both current conductors of the control coil 10 of the brake disconnects when the modulation of the IGBT transistors 8A, 8B on the primary side of the transformer 36 ceases.

The brake controller 7 of FIG. 2 comprises brake switching logic 16, which is fitted to the signal path between the DSP processor 11 and the control gates 8A, 8B of the MOSFET transistors 8A, 8B. Owing to the switching logic, the current supply to the control coil 10 of the brake can be disconnected safely without any mechanical contactors. The switching logic 16 comprises a digital isolator 21, which can be e.g. one with an ADUM 4223 type marking manufactured by Analog Devices. The digital isolator 21 receives its operating voltage for the secondary side 21' from a DC voltage source 40 via the contact 14 of the safety relay, in which case the output of the digital isolator 21 ceases modulating and the signal path from the DSP processor 11 to the control gates of the MOSFET transistors 8A, 8B breaks when the contact 14 opens. The circuit diagram of the brake switching logic 16 in FIG. 2 is, for the sake of simplicity, presented only in connection with the current path of the low-side MOSFET transistor 8B, because the circuit diagram of the switching logic 16 is similar also in connection with the current path of the high-side MOSFET transistors 8A.

FIG. 3 presents an alternative circuit diagram of the brake switching logic. The main circuit of the brake controller 7 is similar to that in FIG. 2. The digital isolator 21 has, however, been replaced with a transistor 46, and the output of the DSP processor 11 has been taken directly to the base of the transistor 46. An MELF resistor 45 is connected to the collector of the transistor 46. Elevator safety instruction EN 81-20 specifies that failure of an MELF resistor into a short-circuit does not need to be taken into account when making a fault analysis, so that by selecting the value of the MELF resistor to be sufficiently large, a signal path from the output of the brake control circuit 11 to the gate of a MOSFET transistor 8A, 8B can be safely prevented when the safety contact 14 is open. Also the brake switching logic 16 comprises a PNP transistor 23, the emitter of which is connected to the input circuit 12 of the safety signal 13. Consequently, the electricity supply from the DC voltage source 40 to the emitter of the PNP transistor 23 of the brake switching logic 16 disconnects, when the contact 14 of the safety relay of the electronic supervision unit 20 opens. At the same time the signal path of the control pulses from the brake control circuit 11 to the control gates of the MOSFET transistors 8A, 8B of the brake controller 7 is disconnected, in which case the MOSFET transistors 8A, 8B open and the power supply from the DC intermediate circuit 2A, 2B to the coil 10 of the brake ceases. The circuit diagram of the brake switching logic 16 in FIG. 3 is, for the sake of simplicity, presented only in respect of the MOSFET transistor 8B connecting to the low-voltage busbar 2B of the DC intermediate circuit, because the circuit diagram of the brake switching logic 16 is similar also in connection with the MOSFET transistor 8A connecting to the high-voltage busbar 2A of the DC intermediate circuit. With the solution of FIG. 3 a simple and cheap switching logic 16 is achieved.

Power supply from the DC intermediate circuit 2A, 2B to the coil 10 of the brake is again allowed by controlling the contact of the safety relay 14 closed, in which case DC voltage is connected from the DC voltage source 40 to the emitter of the PNP transistor 23 of the brake switching logic 16.

As already stated in the preceding, the brake controller 7 of FIG. 1 (and also of FIGS. 2 and 3) comprises separate but similar main circuits for the current supply of the control coils 10 of the first 9A and second 9B machinery brake. The MOSFET transistors 8A, 8B in the first main circuit supply electric power to the electromagnet 10 of the first machinery brake 9A and the MOSFET transistors 8A, 8B of the second main circuit supply electric power to the electromagnet of the second machinery brake 9A. The MOSFET transistors 8A, 8B of both main circuits are controlled with the same processor 11, in which case the current supply to the control coils 10 of the first brake 9A and of the second brake 9B can be controlled with the same processor 11 independently of each other. The processor 11 comprises a bus controller, via which the processor 11 is connected to the same serial interface bus as the elevator control unit 35 and as the electronic supervision unit 20. (20, 35). The DSP processor 11 is configured to disconnect the electricity supply to the control coil 10 of the first machinery brake 9A but to continue the electricity supply from the DC intermediate circuit 2A, 2B of the frequency converter to the control coil 10 of the second machinery brake 9B after it has received from the elevator control unit 35 via the serial interface bus an emergency stop request 65 for starting an emergency stop to be performed at a reduced deceleration. The DSP processor 11 is further configured to disconnect the electricity supply to the control coil of also the second machinery brake 9B after it has received a signal from the elevator control unit 35 via the serial interface bus that the deceleration of the elevator car is below a threshold value. The deceleration of the elevator car can be measured e.g. with an acceleration sensor 61 connected to the elevator car or by measuring the deceleration of the traction sheave of the hoisting machine, and thereby of the elevator car, with an encoder fitted to the shaft of the hoisting machine.

This means that the elevator system of FIG. 1 together with the brake controller of FIG. 2 or 3 enables an emergency braking method, wherein the hoisting machine 6 of the elevator, and thus the elevator car, are braked at a reduced deceleration e.g. during an electricity outage. The use of reduced deceleration is advantageous e.g. in the types of elevator systems in which the friction between the traction sheave of the hoisting machine and the rope is high. High friction can be caused by the ropes not being able to slip on the traction sheave during an emergency stop, when the deceleration of the elevator car might otherwise increase to be unnecessarily high from the viewpoint of a passenger in the elevator car. High friction between a traction sheave and a rope can result e.g. from a coating of the traction sheave and/or of the rope; e.g. the friction between a coated belt and a traction sheave is usually high; in addition friction is high (absolute) when using a toothed belt, which travels in grooves made in the traction sheave.

In the emergency braking method one 9A of the brakes of the hoisting machine is connected by disconnecting the electricity supply to the electromagnet 10 of the aforementioned brake, but the other brake 9B is still kept open by continuing the electricity supply from the DC intermediate circuit 2A, 2B of the frequency converter to the electromagnet 10 of the aforementioned other brake 9B. At the same time the deceleration during an emergency stop of the elevator car is measured, and after a set amount of time has passed also the aforementioned second brake 9B is connected by disconnecting the electricity supply to the electromagnet 10 of the second brake 9B, after the deceleration of the elevator car is below a set threshold value.

The frequency converter 1 of FIG. 1 also comprises indicator logic 17, which forms data about the operating state of the drive prevention logic 15 and of the brake switching logic 16 for the electronic supervision unit 20. FIG. 4 presents how the safety functions of the aforementioned electronic supervision unit 20 and of the frequency converter 1 are connected together into a safety circuit of the elevator. According to FIG. 4 the safety signal 13 is conducted from the DC voltage source 40 of the frequency converter 1 via the contacts 14 of the safety relay of the electronic supervision unit 20 and onwards back to the frequency converter 1, to the input circuit 12 of the safety signal. The input circuit 12 is connected to the drive prevention logic 15 and also to the brake switching logic 16 via the diodes 41. The purpose of the diodes 41 is to prevent voltage supply from the drive prevention logic 15 to the brake switching logic 16/from the brake switching logic 16 to the drive prevention logic 15 as a consequence of a failure, such as a short-circuit et cetera, occurring in the drive prevention logic 15 or in the brake switching logic 16.

The frequency converter of FIG. 1 comprises indicator logic, which forms data about the operating state of the drive prevention logic 15 and of the brake switching logic 16 for the electronic supervision unit 20. The indicator logic 17 is implemented as AND logic, the inputs of which are inverted. A signal allowing startup of a run is obtained as the output of the indicator logic, which signal reports that the drive prevention logic 15 and the brake switching logic are in operational condition and starting of the next run is consequently allowed. For activating the signal 18 allowing the startup of a run the electronic supervision unit 20 disconnects the safety signal 13 by opening the contacts 14 of the safety relay, in which case the electricity supply of the drive prevention logic 15 and of the brake switching logic 16 must go to zero. The indicator logic is described in FIG. 4.

Figure 5:
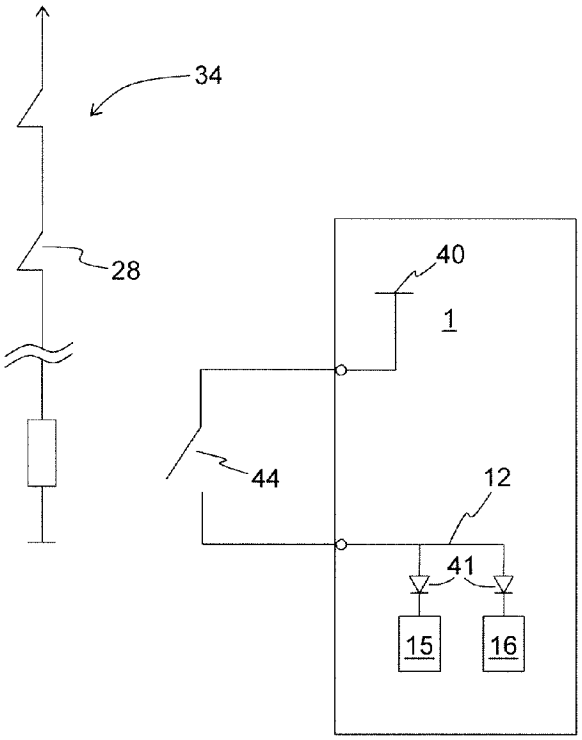
FIG. 5 presents as a circuit diagram the fitting of a brake control circuit according to the invention into connection with the safety circuit of an elevator.

FIG. 5 presents an embodiment of the invention in which the safety logic of the frequency converter 1 is fitted into an elevator having a conventional safety circuit 34. The safety circuit 34 is formed from safety switches 28, such as e.g. safety switches of the doors of entrances to the elevator hoistway, that are connected together in series. The coil of the safety relay 44 is connected in series with the safety circuit 34. The contact of the safety relay 44 opens, when the current supply to the coil ceases as the safety switch 28 of the safety circuit 34 opens. Consequently, the contact of the safety relay 44 opens e.g. when a serviceman opens the door of an entrance to the elevator hoistway with a service key. The contact of the safety relay 44 is wired from the DC voltage source 40 of the frequency converter 1 to the brake switching logic 16 in such a way that the electricity supply to the brake switching logic ceases when the contact of the safety relay 44 opens. Consequently, when the safety switch 28 opens also the passage of control pulses to the IGBT transistors 8A, 8B of the brake controller 7 ceases, and the brakes 9 of the hoisting machine activate to brake the movement of the traction sheave of the hoisting machine.

It is obvious to the person skilled in the art that, differing from what is described above, the electronic supervision unit 20 can also be integrated into the brake controller 7, preferably on the same circuit card as the brake switching logic 16. In this case the electronic supervision unit 20 and the brake switching logic 16 form, however, subassemblies that are clearly distinguishable from each other, so that the fail-safe apparatus architecture according to the invention is not fragmented.

It is further obvious to the person skilled in the art that that the brake controller 7 described above is suited to controlling also a car brake, in addition to a machinery brake 9A, 9B of the hoisting machine of an elevator, without mechanical contactors.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A brake controller for controlling the electromagnetic brake of an elevator, said brake controller comprising:

an input for connecting the brake controller to the DC intermediate circuit of a frequency converter driving the hoisting machine of the elevator;

an input circuit for a safety signal disconnected/connected from outside the brake controller;

two outputs for connecting the brake control to a first and second electromagnets of the brake, controlled with the processor independently of each other, via the first output, electric power is supplied from the DC intermediate circuit of the frequency converter driving the hoisting machine of the elevator to the first electromagnet of a brake, and via the second output, electric power is supplied from the DC intermediate circuit of the frequency converter driving the hoisting machine of the elevator to the second electromagnet;

a solid-state switch for supplying electric power from the DC intermediate circuit of the frequency converter driving the hoisting machine of the elevator via the two outputs to the electromagnets of the brake;

a brake switching logic connected to the input circuit and configured to prevent passage of a control pulses to a control pole of the solid-state switch when the safety signal is disconnected; and the processor, with which the operation of the brake controller is controlled by producing control pulses in the control pole of the solid-state switch of the brake controller, wherein the processor comprises a communications interface, via which the processor is connected to the elevator control; and the brake controller is configured to disconnect the electricity supply to the first electromagnet but to continue the electricity supply from the DC intermediate circuit of the frequency converter to the second electromagnet after brake controller has received from the elevator control an emergency stop request for starting an emergency stop to be performed at a reduced deceleration.

2. The brake controller according to claim 1, wherein the brake switching logic is configured to allow passage of the control pulses to the control pole of the switch of the brake controller when the safety signal is connected.

3. The brake controller according to claim 1, wherein the brake controller comprises indicator logic for forming a signal permitting startup of a run, and the indicator logic is configured to activate, and to disconnect, the signal permitting startup of a run on the basis of the status data of the brake switching logic.

4. The brake controller according to claim 1, wherein:

a signal path of the control pulses travels to the control pole of the switch of the brake controller via the brake switching logic; and the electricity supply to the brake switching logic is arranged via the signal path of the safety signal.

5. The brake controller according to claim 1, wherein the signal path of the control pulses from the processor to the brake switching logic is arranged via an isolator.

6. The brake controller according to claim 1, wherein:

the brake switching logic comprises a bipolar or multipolar signal switch, via which the control pulses travel to the control pole of the switch of the brake controller; and at least one pole of the signal switch is connected to the input circuit in such a way that the signal path of the control pulses through the signal switch breaks when the safety signal is disconnected.

7. The brake controller according to claim 4, wherein the electricity supply occurring via the signal path of the safety signal is configured to be disconnected by disconnecting the safety signal.

8. The brake controller according to claim 1, wherein the brake controller is implemented without any mechanical contactors.

9. A brake controller for controlling the electromagnetic brake of an elevator, comprising:

an input for connecting the brake controller to a DC electricity source;

an output for connecting the brake controller to an electromagnet of the brake:

a transformer, which comprises a primary circuit and a secondary circuit;

a rectifying bridge, which is connected between the secondary circuit of the transformer and the output of the brake controller;

wherein:

the input comprises a positive and a negative current conductors;

the brake controller comprises:

a high-side switch and a low-side switch, which are connected in series with each other between the positive and negative current conductors;

a processor, with which the electricity supply to the electromagnet of the brake is controlled by producing control pulses in control poles of the high-side switch and low-side switch; and two capacitors, which are connected in series with each other between the positive and the negative current conductors; and the primary circuit of the transformer is connected between a connection point of the high-side switch and low-side switch and a connection point of the capacitors.

10. The brake controller according to claim 1, wherein:

the brake controller comprises two controllable switches, the first of which is configured to supply electric power to the first electromagnet of the brake and the second is configured to supply electric power to the second electromagnet of the brake;

the processor is configured to control the electricity supply to the first electromagnet by producing control pulses in the control pole of the first switch; and the processor is configured to control the electricity supply to the second electromagnet by producing control pulses in the control pole of the second switch.

11. The brake controller according to claim 1, wherein the brake controller is configured to disconnect the electricity supply to the first and to the second electromagnet after the brake controller has received from the elevator control a signal that the deceleration of the elevator car is below a threshold value.

12. An elevator system, comprising the brake controller according to claim 1 for controlling the brake of the hoisting machine of the elevator.

13. The elevator system according to claim 12, further comprising:

a hoisting machine;

an elevator car;

the frequency converter, with which the elevator car is driven by supplying electric power to the hoisting machine;

sensors configured to monitor the safety of the elevator; and an elevator control, which comprises an input for the data of the sensors, wherein the elevator control is configured to form an emergency stop request for starting an emergency stop to be performed at a reduced deceleration, when the data received from the sensors indicates that the safety of the elevator is endangered.

14. The elevator system according to claim 13, wherein:

the elevator system comprises an acceleration sensor, which is connected to the elevator car;

the elevator control comprises an input for the measuring data of the acceleration sensor;

the elevator control comprises a memory, in which is recorded a threshold value of the deceleration of the elevator car;

the elevator control is configured to compare the measuring data of the acceleration sensor to the threshold value for the deceleration of the elevator car recorded in memory; and the elevator control is configured to form a signal that the deceleration of the elevator car is below the threshold value.

* * * * *